US012006172B2

(12) United States Patent
Cordelier et al.

(10) Patent No.: US 12,006,172 B2
(45) Date of Patent: Jun. 11, 2024

(54) DEVICE AND METHOD FOR CHANGING A SHEET PILE IN A SHEET PILE FEEDER

(71) Applicant: BOBST MEX SA, Mex (CH)

(72) Inventors: Jérémy Cordelier, Puidoux (CH); Quentin Freymond, Yverdon-les-Bains (CH)

(73) Assignee: BOBST MEX SA, Mex (CH)

( * ) Notice: Subject to any disclaimer, the term of this patent is extended or adjusted under 35 U.S.C. 154(b) by 165 days.

(21) Appl. No.: 17/757,235

(22) PCT Filed: Dec. 7, 2020

(86) PCT No.: PCT/EP2020/084907

§ 371 (c)(1),
(2) Date: Jun. 13, 2022

(87) PCT Pub. No.: WO2021/122109

PCT Pub. Date: Jun. 24, 2021

(65) Prior Publication Data

US 2023/0002177 A1 Jan. 5, 2023

(30) Foreign Application Priority Data

Dec. 19, 2019 (EP) ..... 19020713

(51) Int. Cl.
*B65H 1/26* (2006.01)
*B65H 1/14* (2006.01)

(52) U.S. Cl.
CPC ..... *B65H 1/263* (2013.01); *B65H 1/14* (2013.01); *B65H 2301/42256* (2013.01); *B65H 2405/323* (2013.01); *B65H 2515/50* (2013.01)

(58) Field of Classification Search
CPC ..... B65H 1/263; B65H 1/14; B65H 2301/42256; B65H 2405/323; B65H 2515/50
See application file for complete search history.

(56) References Cited

U.S. PATENT DOCUMENTS 4,478,403 A * 10/1984 Byrt ..... B65H 33/08 271/189
4,796,879 A * 1/1989 Martini ..... B65H 31/3063 414/796.1

(Continued)

FOREIGN PATENT DOCUMENTS

CN 1094688 A 11/1994
CN 102070028 A 5/2011

(Continued)

OTHER PUBLICATIONS

International Search Report, PCT/EP2020/084907, Feb. 5, 2021, 4 pages, Europe.

*Primary Examiner* — Thomas A Morrison
(74) *Attorney, Agent, or Firm* — Bookoff McAndrews PLLC

(57) ABSTRACT

A device for changing a sheet pile (14) in a sheet feeder (10) for a sheet treating machine comprises a main pile supporting unit (18) with a main pile actuating unit (20) for lifting and lowering the main pile supporting unit (18), wherein the main pile supporting unit (18) comprises a supporting surface (22) adapted to support a pallet (16) carrying a sheet pile (14). The device further comprises a residual pile supporting unit (24) with a residual pile actuating unit (26) for lifting and lowering the residual pile supporting unit (24). The residual pile supporting unit (24) comprises a plurality of residual pile bars (38) extending substantially parallel to each other and being substantially parallel to the supporting surface (22) of the main pile supporting unit (18), wherein the residual pile bars (38) are coupled to a bar actuating unit (43) adapted to move the residual pile bars (38) on a line parallel to the direction of extension of the respective residual pile bar (38) into a sheet pile region (30) and retract the residual pile bars (38) from the sheet pile region (30). The bar actuating unit (43) is configured to (Continued)

Figure 1:
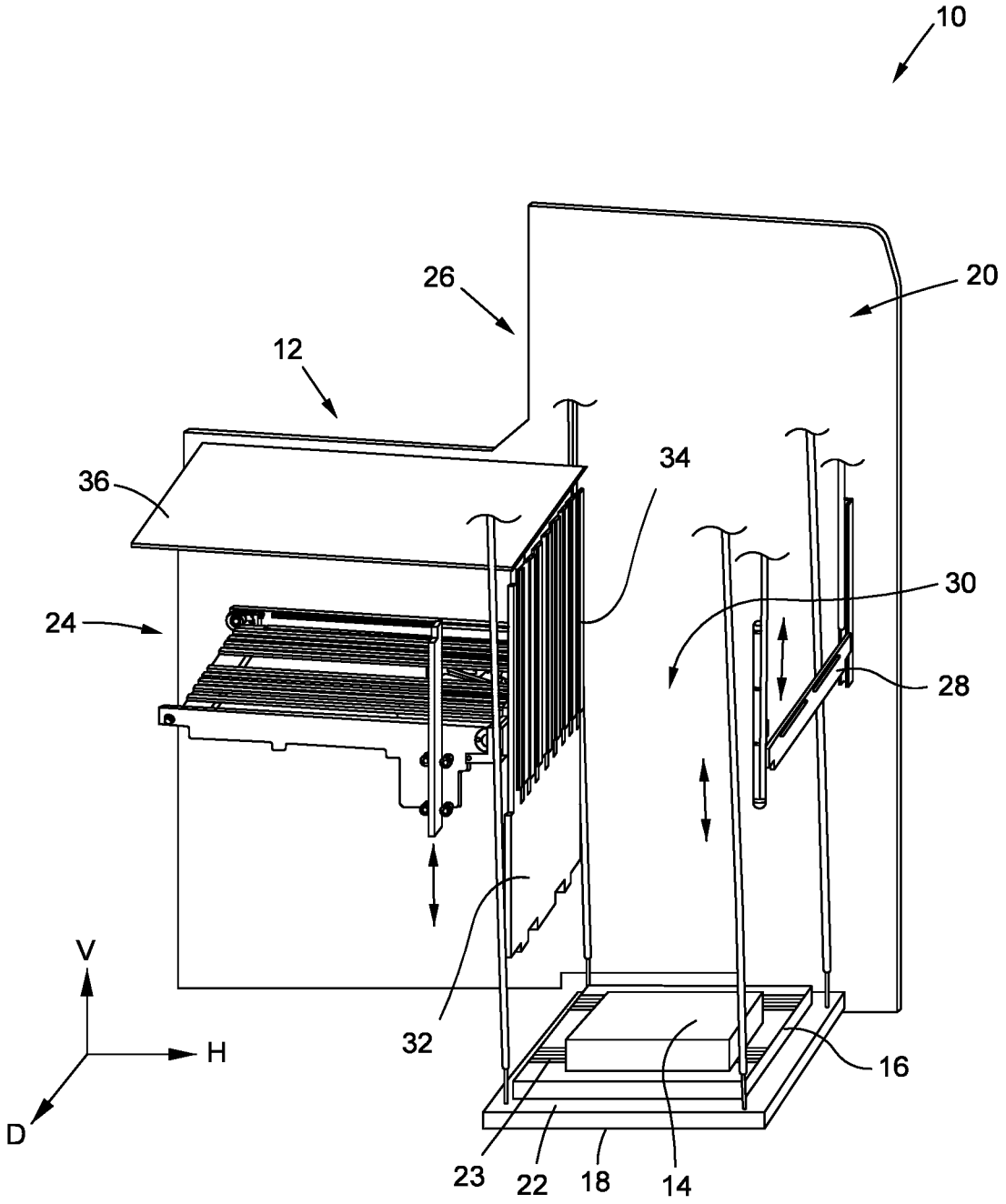

retract the residual pile bars (38) while introducing an oscillatory movement of the residual pile bars (38) along the direction of extension of the residual pile bars (38).
Further, a method for changing a sheet pile (14) in a sheet feeder (10) is presented.

2 Claims, 4 Drawing Sheets

(56) References Cited

U.S. PATENT DOCUMENTS

| | | | | |
|---|---|---|---|---|
| 5,011,126 | A | 4/1991 | Suzuki et al. | |
| 5,295,681 | A | 3/1994 | Blaser | |
| 5,669,755 | A * | 9/1997 | Zahn | B65H 31/32 414/789.5 |
| 9,533,845 | B2 | 1/2017 | Mueller et al. | |
| 2010/0187748 | A1* | 7/2010 | Monch | B65H 1/263 271/10.01 |
| 2011/0014021 | A1* | 1/2011 | Reid | B65H 31/30 414/389 |
| 2012/0132091 | A1* | 5/2012 | Roth | B65H 31/3081 100/215 |
| 2013/0140763 | A1* | 6/2013 | Jakob | B65H 31/32 271/220 |
| 2015/0050113 | A1* | 2/2015 | Cugnoni | B65H 31/32 271/218 |
| 2019/0039847 | A1* | 2/2019 | Chatry | B65H 33/04 |
| 2020/0122952 | A1* | 4/2020 | Katagiri | B65H 29/46 |
| 2022/0089389 | A1* | 3/2022 | Rod | B65H 1/263 |

FOREIGN PATENT DOCUMENTS

| | | | |
|---|---|---|---|
| CN | 104334483 | A | 2/2015 |
| CN | 105417220 | A | 3/2016 |
| CN | 105417221 | A | 3/2016 |
| DE | 10320117 | A1 | 11/2004 |
| DE | 102010053587 | A1 | 6/2012 |
| DE | 102015217170 | A1 | 3/2016 |
| GB | 2301816 | A | 12/1996 |
| JP | H0489259 | A | 3/1992 |
| JP | H08333027 | A | 12/1996 |
| JP | 2694732 | B2 | 12/1997 |
| JP | H10218389 | A | 8/1998 |
| JP | 3134228 | B2 | 2/2001 |
| JP | 2016060643 | A | 4/2016 |
| TW | 201529342 | A | 8/2015 |

* cited by examiner

DEVICE AND METHOD FOR CHANGING A SHEET PILE IN A SHEET PILE FEEDER

CROSS-REFERENCE TO RELATED APPLICATION(S)

This patent application is a National Stage Application under of 35 U.S.C. § 371 of International Patent Application No. PCT/EP2020/084907, filed on Dec. 7, 2020, which claims priority to European Application No. 19020713.4, filed on Dec. 19, 2019, the entireties of which are incorporated herein by reference.

The invention is directed to a device and a method for changing a sheet pile in a sheet feeder for a sheet treating machine.

Sheet treating machines in the sense of the present patent application are for example sheet cutting machines or sheet printing machines. Of course, other types of sheet treating machines are also addressed by the present invention.

In general, sheet treating machines can be adapted to any kind of sheet material. Examples thereof are paper, cardboard, plastics, metal, composite materials, and leather.

In known devices for changing a sheet pile in a sheet feeder, the movement of a main pile supporting unit usually is synchronized to sheets being taken from the main pile. This means that the main pile supporting unit is raised by a distance corresponding to a thickness of a sheet each time a sheet is taken from the sheet pile.

In alternative solutions, the main pile supporting unit is raised by a distance corresponding to a cumulated thickness of a certain number of sheets after this number of sheets has been taken from the main pile.

Additionally, a residual pile supporting unit is usually synchronized to the main pile supporting unit when residual pile bars are pushed into slots of a pallet being positioned on the main pile supporting unit. In a situation when the sheet pile is only supported by the residual pile bars, they are synchronized to the sheets being taken from the sheet pile in the same way the main pile supporting unit is synchronized thereto (cf. above).

As a result, such a device for changing a sheet pile in a sheet feeder allows to change a sheet pile, more precisely a sheet pile being positioned on a corresponding pallet, without having to interrupt the flow of sheets being fed from the sheet feeder to a sheet treating machine. Consequently, the sheet treating machine can be operated non-stop.

It has always been a challenge in the fields of sheet feeders to find a good compromise between high operational speeds and secure and gentle handling of sensitive sheets. In other words, high operational speeds are limited by the requirement of not causing any damage or detriment to the sheets of the sheet pile being processed in the sheet feeder.

DE102010053587 uses a non-stop device at the sheet feeder using two bands on each bar that supports the residual pile. A roller holds the bands at the tip of the bar such that when the bars are inserted or removed, the band unrolls itself so that there are no relative motions between the band and the piles.

It is therefore an object of the present invention to eliminate or at least reduce the conflict of objectives mentioned above. An improved and simpler device for changing a sheet pile in a sheet feeder shall be provided, which is able to feed sheets at high operational speeds without risking to damage these sheets.

The object of the invention is solved by a device for changing a sheet pile in a sheet feeder for a sheet treating machine, comprising a main pile supporting unit with a main pile actuating unit for lifting and lowering the main pile supporting unit, wherein the main pile supporting unit comprises a supporting surface adapted to support a pallet carrying a sheet pile. The device further comprises a residual pile supporting unit with a residual pile actuating unit for lifting and lowering the residual pile supporting unit, wherein the residual pile supporting unit comprises a plurality of residual pile bars extending substantially parallel to each other and being substantially parallel to the supporting surface of the main pile supporting unit. The residual pile bars are coupled to a bar actuating unit adapted to move the residual pile bars on a line parallel to the direction of extension of the respective residual pile bar into a sheet pile region and retract the residual pile bars from the sheet pile region. The bar actuating unit is configured to retract the residual pile bars while introducing an oscillatory movement of the residual pile bars along the direction of extension of the residual bars.

The invention is based on the idea that to prevent sheets from being moved when the residual pile bars are retracted, the friction forces between the residual pile bars and the sheets being in contact with the residual pile bars must be lower than the friction forces between the sheets of the respective sheet piles.

This is achieved by introducing oscillatory movements voluntarily while retracting the residual pile bars from the sheet pile region. At this point, the residual pile bars are engaged between an upper end of a replacement sheet pile and the lower end of a residual pile currently being processed. Therefore, the residual pile bars need to be retracted in such a way that neither the sheets of the residual sheet pile nor the sheets of the replacement sheet pile experience any damage or detriment, which could lead to a full machine stop in the worst case.

The movement for extending and extracting the residual pile bars into and from the sheet pile region, respectively, is generally a horizontal movement. Therefore, oscillatory movements of the residual pile bars along the direction of their extension correspond to horizontal movements, too.

The inventors have found that with these oscillations sliding movements are encouraged over adhesion between the residual pile bars and the sheets of the residual pile and the main pile, respectively. As the sliding motion is determined by dynamic friction in contrast to static friction in the case of adhesion, the overall frictional forces between the residual pile bars and the sheets are strongly reduced.

Most importantly, the dynamic friction between the residual pile bars and the sheets is lower than the static friction between the sheets of the respective sheet pile. Therefore, the sheets will stay in place while the residual pile bars can slide between the residual sheet pile and the replacement sheet pile. In this way, the risk to drag a sheet along with the residual pile bars during retraction is reduced. This also reduces the overall risk of damaging a sheet and the risk of a stop of the machine, thereby reducing machine downtime. Further, means for introducing oscillatory movements are easy to implement and do not increase the space requirements of the device.

Generally, the amplitude of the oscillatory movement is small compared to the total length of the withdrawal movement. Therefore, a sufficiently high number of oscillations can be executed during withdrawal of the residual pile bars. However, the oscillations have to be large enough to ensure that dynamic friction determines the behavior between the residual pile bars and the sheets.

The oscillation frequency has to be chosen, too, to ensure that dynamic friction determines the behavior between the residual pile bars and the sheets. Lower oscillation frequencies would not provide the desired frictional behavior while higher oscillation frequencies require more expensive equipment.

According to an embodiment, the bar actuating unit comprises a supporting bar extending in an orthogonal direction with respect to the residual pile bars and being parallel to the supporting surface, wherein respective first end sections of each of the residual pile bars are coupled to the supporting bar. Further, the supporting bar is coupled to a transmission configured to move the supporting bar along the line parallel to the direction of extension of the residual pile bars. The transmission can be a chain transmission, a belts transmission, a transmission using a set of gears, a pneumatic cylinder based transmission or any other suitable transmission or combination thereof.

The supporting bar provides a secure mounting for the first end sections of the residual pile bars. At the same time, movement along the direction of extension of the residual pile bars can be easily achieved by moving the supporting bar to which all of the residual pile bars are attached.

In other words, all the residual pile bars are moving synchronously at the same time along the direction of extension of the residual pile bars. This simplifies the overall design of the bar actuating unit and of the overall device.

A chain transmission is especially suited as driving unit for the bar actuating unit, as the maximum range of the movement of the residual pile bars is known and the extension and retraction of the residual pile bars is done along the same axis, just in opposite directions. The maximum range of the movement of the residual pile bars can correspond to full extension of the residual pile bars into the sheet pile region.

The transmission can be driven by an electric motor strong enough to cause a relative motions (i.e. a sliding) between the bars and the pile of sheets, for any type of sheet material, format and weight used in the machine.

In another embodiment, the residual pile bars supporting unit further comprises an alignment unit, wherein the alignment unit comprises a sheet with openings, in which the residual pile bars are arranged. Further, the residual pile bars supporting unit comprises an alignment actuator, especially an electric drive, for moving the sheet along the direction perpendicular of the direction of extension of the residual pile bars.

The alignment unit is used for ensuring that the residual pile bars have the correct position before being moved into the sheet pile region to interact with slots in the pallet, on which the main sheet pile is placed. In this way, misalignments between the residual pile bars and the pallet, which could lead to interruptions of the sheet feeder, are prevented.

The object of the invention is further solved by a method for changing a sheet pile in a sheet feeder a sheet treating machine, comprising the following steps:

a) detecting a limit height of a sheet pile processed in the sheet feeder, wherein the sheet pile is supported on a pallet being arranged on a main pile supporting unit,
b) supporting the sheet pile by a residual pile supporting unit in that a plurality of residual pile bars are pushed into respective slots of the pallet,
c) withdrawing the pallet being arranged on the main pile supporting unit from the sheet pile and placing a replacement pallet carrying a replacement sheet pile on the main pile supporting unit,
d) bringing an upper end of the replacement sheet pile in contact with the residual pile bars such that the residual pile bars are engaged between the lower end of the sheet pile and an upper end of the replacement sheet pile, and
e) retracting the residual pile bars from a sheet pile region such that the sheet pile is supported on the replacement sheet pile, wherein the residual pile bars oscillate along the direction of extension of the residual pile bars while being retracted.

The inventive method provides a way for non-stop operation of the sheet feeder in the sheet treating machine. The oscillatory movement during retraction of the residual pile bars ensures that sliding movements are encouraged over adhesion between the residual pile bars and the sheets of the sheet pile and between the residual pile bars and the replacement sheet pile. As the sliding motion is determined by dynamic friction in contrast to static friction in the case of adhesion, the overall frictional forces between the residual pile bars and the sheets are reduced, therefore reducing the risk of dragging sheets along with the residual pile bars.

All residual pile bars can be retracted at the same time, with the same speed and/or with the same oscillations. With other words, all residual pile bars are moved synchronously. This reduces the complexity of the necessary retraction mechanism, therefore reducing the cost of the method and a sheet feeder used therein.

The residual pile bars are especially residual pile bars of the device as described before. The same properties and advantages described in respect to the device therefore apply to the method for changing the sheet pile as well.

Figure 2:
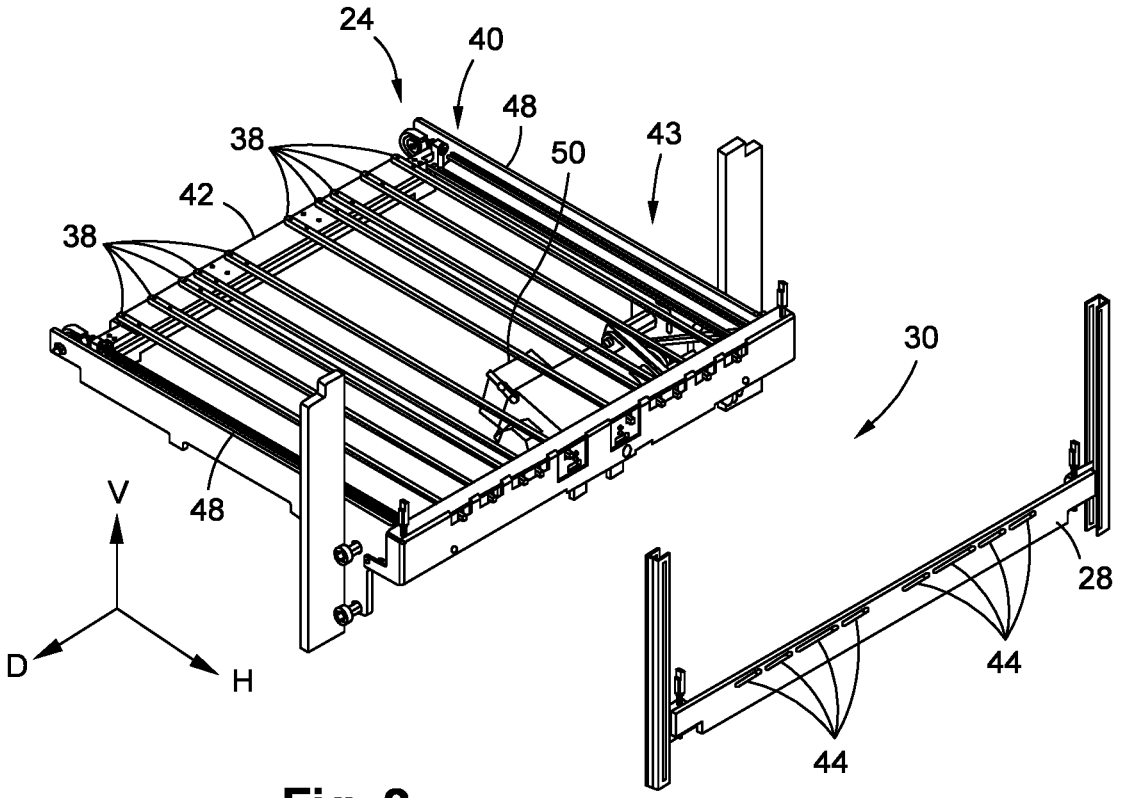
Figure 3:
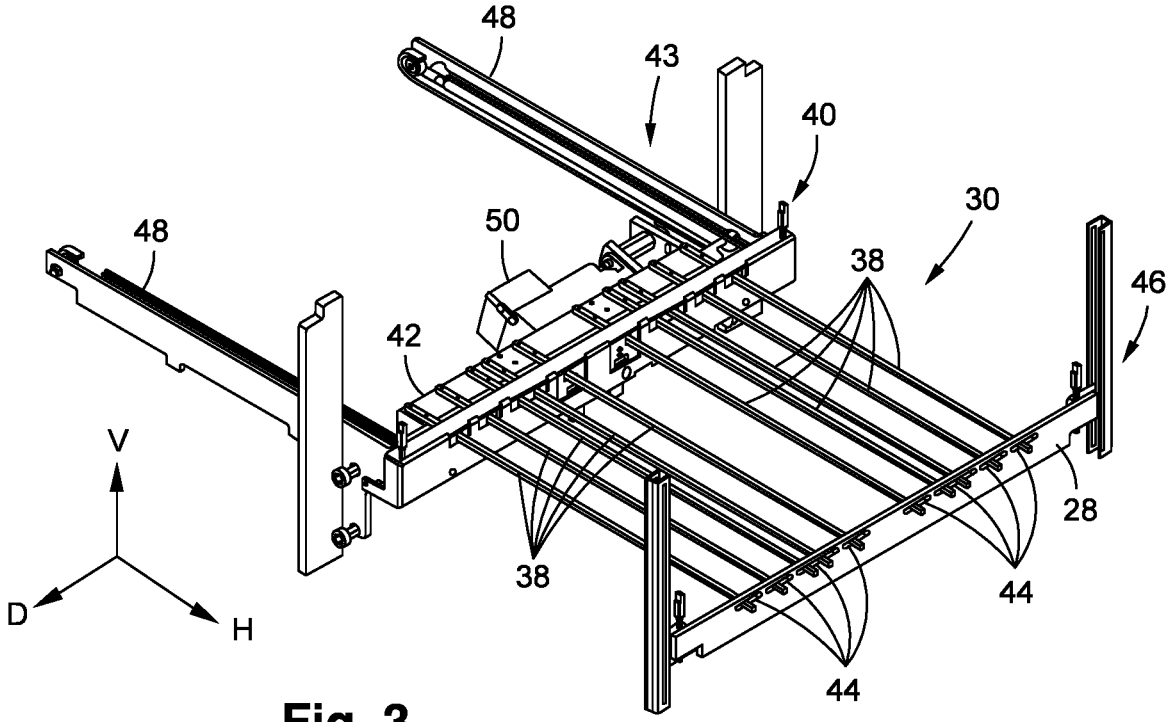
Figure 4:
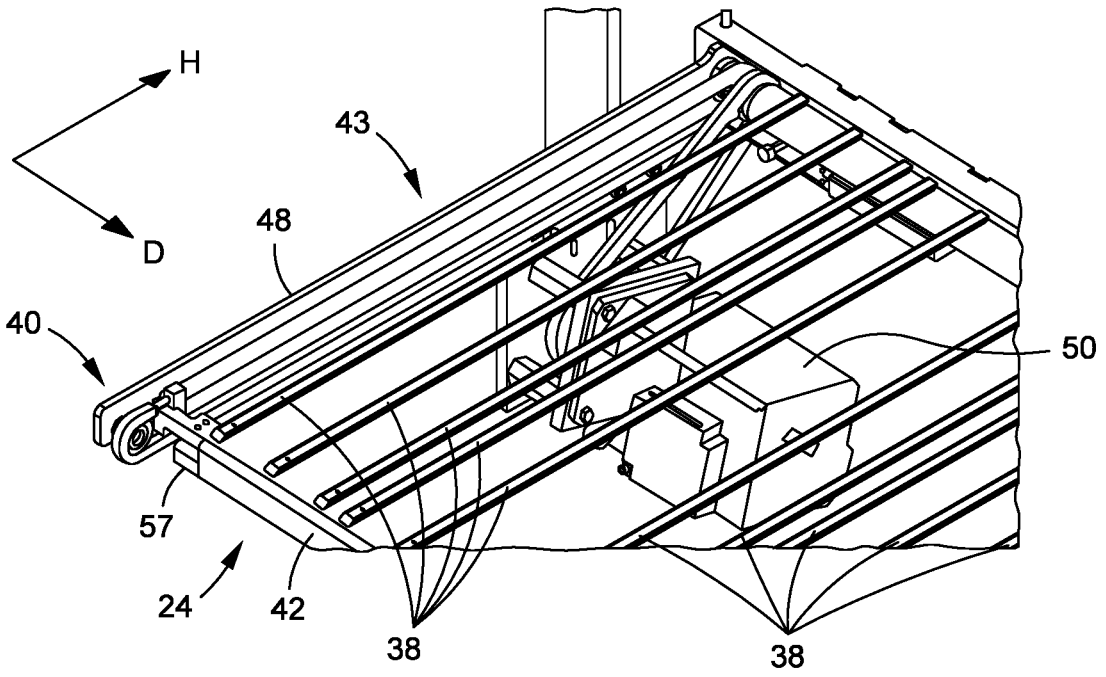
Figure 5:
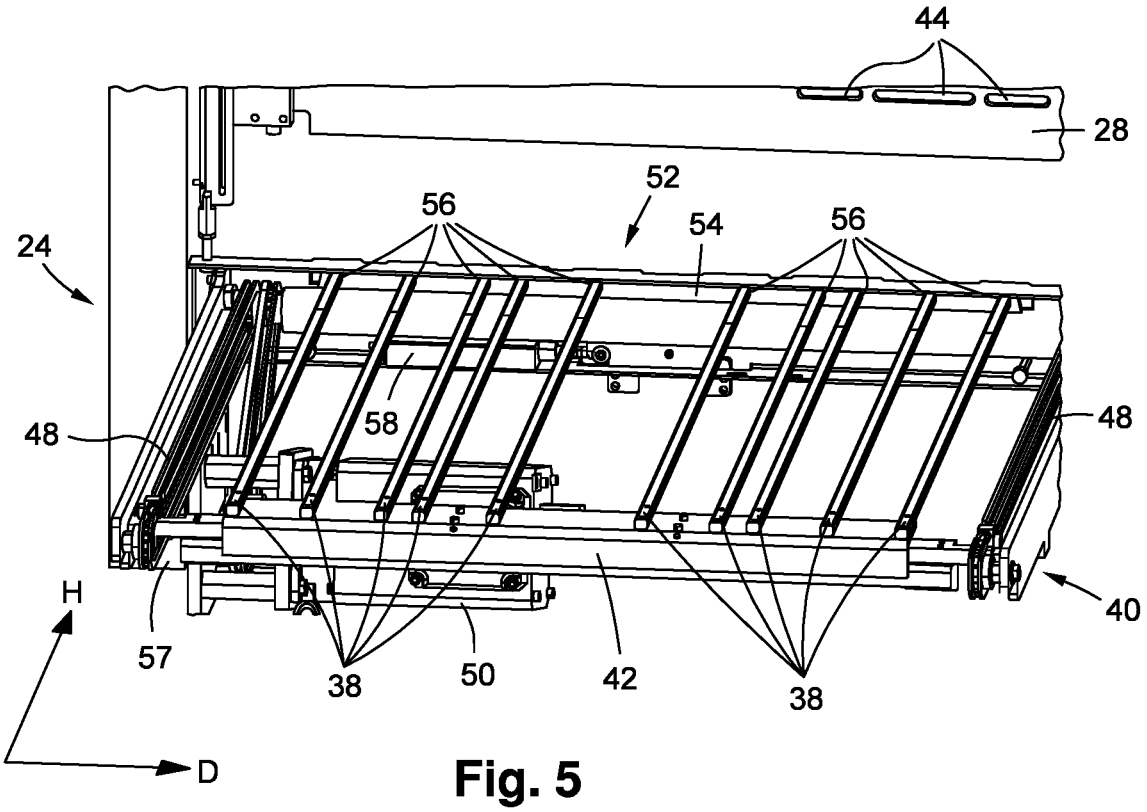
Figure 6:
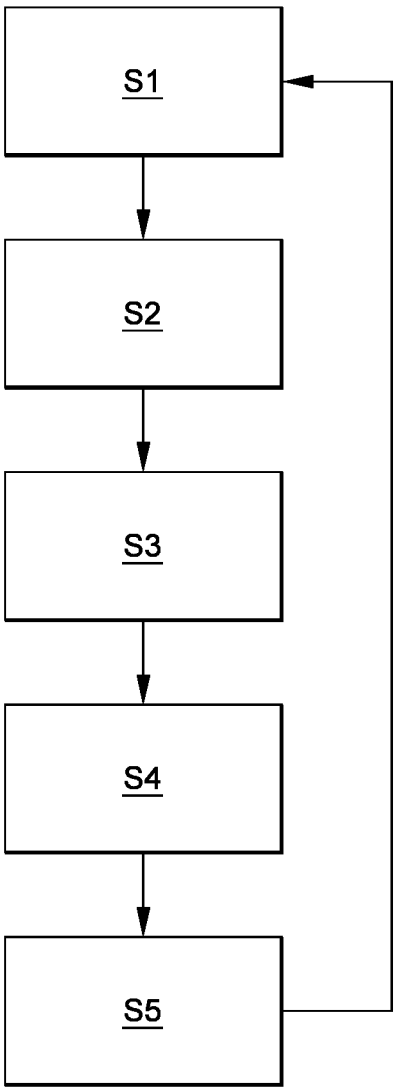

Further aspects and advantages of the invention will now be described with reference to the attached figures. In the drawings FIG. 1 shows a device for changing a sheet pile in a sheet feeder for a sheet treating machine according to the invention, FIG. 2 shows a residual pile supporting unit of the device of FIG. 1 with retracted residual pile bars, FIG. 3 shows the residual pile supporting unit of FIG. 2 with extended residual pile bars, FIG. 4 shows a detail of the residual pile supporting unit of FIG. 2, FIG. 5 shows another detail of the residual pile supporting unit of FIG. 2, and FIG. 6 shows a schematic sketch of the inventive method for changing a sheet pile.

FIG. 1 shows a sheet feeder 10 comprising a device 12 for changing a sheet pile 14 placed on a pallet 16. Sheet feeder 10 is part of a (not shown) sheet treating machine.

In FIG. 1, the sheet pile 14 comprises four sheets of cardboard. Generally, the device 12 can be used for sheets made out of a variety of different materials, for example out of paper, cardboard, plastics, metal, composite materials, and/or leather. Of course, the number of sheets in the sheet pile 14 can also be different from the one shown in FIG. 1, preferably a high number of sheets are provided in the sheet pile 14 on the pallet 16, for example 1000 sheets or more, in general between 200 and 10'000 sheets.

The sheet pile 14 in FIG. 1 only covers part of the upper surface of the pallet 16. Generally, the sheet pile 14 could also cover less or more of the upper surface of the pallet 16, for example the whole upper surface of the pallet 16.

The pallet 16 is supported on a main pile supporting unit 18, which is coupled to a main pile actuating unit 20 for lifting and lowering the main pile supporting unit 18. More precisely, the pallet 16 is supported on a supporting surface 22 of the main pile supporting unit 18.

With the terms "lifting" and "lowering" a movement along a vertical axis V shown in FIG. 1 is understood. Correspondingly, the term "horizontal movement" means movement parallel to the horizontal axis H shown in FIG. 1, which is perpendicular to the vertical axis V.

The pallet 16 further comprises a number of slots 23, which extent substantially parallel to the axis H throughout the pallet 16. The slots 23 are designed such that they are open on their upper side, i.e. on the side not facing the supporting surface 22.

It is noted that in FIG. 1 only a few slots 23 are represented in a very schematic way. In a preferred embodiment, the pallet 16 may be a standard pallet having a number of slots 23 usual for standard pallets.

The device 12 further comprises the residual pile supporting unit 24, which is coupled to a residual pile actuating unit 26 for lifting and lowering the residual pile supporting unit 24.

Further, the residual pile actuating unit 26 is also coupled to a crossbar 28, which can also be lifted and lowered by the residual pile actuating unit 26. The crossbar 28 is lifted and lowered synchronously with the residual pile supporting unit 24.

The area between the residual pile supporting unit 24 and the crossbar 28 is termed sheet pile region 30, which is large enough to accommodate the main pile supporting unit 18, when it is lifted to the height of the residual pile supporting unit 24.

In front of the residual pile supporting unit 24, on the side facing the crossbar 28, a blocking element 32 is provided, which extends along the vertical axis V. In the part of the blocking element 32 which is in front of the possible heights of the residual pile supporting unit 24, the blocking element 32 is made of individual blocking bars 34 spaced apart of each other along an axis D shown in FIG. 1. The axis D is perpendicular to both axes V and H.

A loading table 36 is arranged above the residual pile supporting unit 24 at a height along the vertical direction V above the blocking element 32. Sheets are fed by the device 12 from the main pile support unit 18 to the loading table 36.

The residual pile supporting unit 24 is shown in more detail in FIG. 2.

The residual pile supporting unit 24 comprises a plurality of residual pile bars 38. The residual pile bars 38 extend substantially parallel to each other and substantially parallel to the supporting surface 22 of the main pile supporting unit 18 (c.f. FIG. 1).

Accordingly, the direction of extension of the residual pile bars 38 is substantially parallel to the horizontal axis H.

The residual pile bars 38 are movable and can be extended and withdrawn into and from the sheet pile region 30 along a line parallel to the direction of extension of the respective residual pile bars 38, respectively.

In order to allow for this movement, the residual pile bars 38 are coupled at first end sections 40 to a supporting bar 42 of a bar actuating unit 43 of the residual pile supporting unit 24.

The supporting bar 42 extends in an orthogonal direction with respect to the residual pile bars 38 and is parallel to the supporting surface 22 of the main supporting unit 18 (c.f. FIG. 1), i.e. along a direction parallel to axis D.

Thus, the residual pile bars 38 are arranged in the residual pile supporting unit 24 in a rake-like manner.

In the example shown, the supporting bar 42 is made from sheet metal.

In the shown embodiment, ten residual pile bars 38 are used. Of course, different numbers of residual pile bars 38 can be used, too. In general, the number of residual pile bars 38 is inferior to the number of slots 23 of the pallet 23. However, the number of residual pile bars 38 must not be higher than the number of slots 23.

The residual pile bars 38 are typically arranged spaced apart from each other along a direction parallel to axis D, wherein the residual pile bars can spaced regularly, especially evenly, or irregularly of each other.

As can be seen from FIGS. 2 and 3, by moving the supporting bar 42 along the axis H and towards the crossbar 28, the residual pile bars 38 can be moved into the sheet pile region 30.

When being fully extended, the residual pile bars 38 are arranged in openings 44 of the crossbar 28 with second end sections 46, wherein the second end section 46 describes the end of the respective residual pile bar 38, which is opposite of its first end section 40.

The movement of the supporting bar 42 is achieved by a chain transmission 48, which is driven by an electric motor 50. FIG. 4 shows a part of the residual pile supporting unit 24, in which the connection between the chain transmission 48 and the supporting bar 42 is shown in detail.

The chain transmission 48 allows horizontal movement of the supporting bar 42, and therefore of the residual pile bars 38, i.e. parallel to the axis H.

The supporting bar 42 is mounted on a supporting rail 57 of the bar actuating unit 43 such that the supporting bar 42 can slide along an axis parallel to axis D.

FIG. 5 shows the residual pile supporting unit 24 from another angle so that an alignment unit 52 can be seen in more detail. The alignment unit 52 comprises a sheet 54 with apertures 56, in which the residual pile bars 38 are arranged.

The alignment unit 52 further comprises an alignment actuator 58 which allows moving the sheet 54 along a direction perpendicular of the direction of extension of the residual pile bars 38, i.e. along a direction parallel to the axis D.

The number of the residual pile bars 38, of openings 44 and of apertures 56 can be different. Preferably, each residual pile bars 38 is supported in one aperture 56. The number of openings 44 can be inferior to the number of residual pile bars 38, if the size of the openings 44 is large enough to incorporate more than one residual pile bars 38.

In the following, the operation of the sheet feeder 10 with the device 12 for changing a sheet pile 14 is explained.

During operation of the sheet feeder 10, a sheet pile 14 is supported on a pallet 16 on the main pile supporting unit 18. The main pile supporting unit 18 is lifted to a height such that always the uppermost sheet of the sheet pile 14 can be transferred to the loading table 36 for further processing.

Therefore, the main pile supporting unit 18 is steadily moved upwards by the main pile actuating unit 20. The upwards movement might be continuous or in steps, wherein each step can correspond to the height of a single or of multiple sheets.

The height of the main pile supporting unit 18 and/or the sheet pile 14 can be monitored by a sensor, allowing to monitor the remaining height of the sheet pile 14. The sensor might be a light barrier, a camera and/or a balance.

This allows detecting a limit height of the sheet pile 14 processed by the sheet feeder 10 (step S1 in FIG. 6).

Once a predefined limit height of the sheet pile 14 is detected, it is concluded that the replacement sheet pile needs to be provided in the sheet feeder 10.

To this end, the residual pile supporting unit 24 has to be arranged by the residual pile actuating unit 26 at the same height as the main pile supporting unit 18. In particular, the residual pile bars must be at the same height than the slots 23 of the pallet 16. Additionally, the upwards movement, i.e. lifting, along the axis V of the main pile supporting unit 18 is to be synchronized with an upwards movement of the residual pile supporting unit 24.

Further, the alignment unit 52 of the residual pile supporting unit is used to align the residual pile bars 38 with the slots 23 of the pallet 16. For this, the sheet 54 is moved by the alignment actuator 58 along the axis D until the apertures 56 are arranged in front of the slots 23.

As the residual pile bars 32 are arranged in the apertures 56 and the supporting bar 42 can be moved along the supporting rail 57, the movement of the sheet 54 results in the alignment of the residual pile bars 32 in front of the slots 23 of the pallet 16.

Then, the supporting bar 42 is moved by the chain transmission 48 along a direction parallel to axis H in the direction of the pallet 16 and the crossbar 28, resulting in a horizontal movement of the residual pile bars 38 in the direction of their extension.

Therefore, the residual pile bars 38 are pushed into the respective slots 23 of the pallet 16, resulting in the sheet pile 14 currently being processed, which will also be referred to as residual sheet pile, being supported by the residual pile supporting unit 24 (step S2 in FIG. 6).

Once the residual sheet pile is fully supported on the residual pile bars 38, the pallet 16 can be withdrawn by lowering the main pile supporting unit 18 with the main pile actuating unit 20. As the slots 23 of the pallet 16 are open in the direction of the upper surface of the pallet 16, the residual pile bars 32 will no longer be within the slots 23 and will support the residual sheet pile at the current height.

Of course, this means that the movement of the main pile supporting unit 18 and the residual pile supporting unit 24 is not synchronized anymore. While the main pile supporting unit 18 is lowered, the residual pile supporting unit 24 keeps lifting the residual sheet pile so that the transfer of sheets to the loading table 36 can be done without interruption, i.e. non-stop.

After lowering the main part supporting unit 18, the now empty pallet 16 can be withdrawn and a new replacement pallet carrying a replacement sheet pile can be put onto the main pile supporting unit 18 (step S3 in FIG. 6).

Then, the main pile supporting unit 18 is lifted again until the upper end of the replacement sheet pile is brought in contact with the lower side of the residual pile bars 38.

This results in the residual pile bars 38 being engaged between the lower end of the sheet pile 14, i.e. the residual sheet pile, and the upper end of the replacement sheet pile (step S4 in FIG. 6).

Finally, the residual pile bars 38 are retracted from the sheet pile region 30 such that the residual sheet pile is supported on the replacement sheet pile. During this movement, the residual pile bars 38 oscillate along the direction of extension of the residual pile bars, i.e. along a direction parallel to axis H (step S5 and FIG. 6).

The oscillations ensure that the static friction between the sheets in the residual sheet pile and in the replacement sheet pile, respectively, is higher than the dynamic friction of the retracting residual pile bars 38 and each of the two sheet piles, i.e. the residual sheet pile and the replacement sheet pile. Therefore, no sheet is dragged along with the residual pile bars 38, allowing for non-stop operation of the sheet feeder 10.

This is further ensured by the blocking element 32, which blocks unwanted movements of sheets into the direction of the residual pile supporting unit 24.

The blocking bars 34 are spaced apart of each other in such a way that they do not block the movement of the residual pile bars 38.

Due to the fixation of the residual pile bars 38 on the supporting bar 42, all residual pile bars 38 are retracted at the same time, with the same speed and/or with the same oscillations, resulting in an overall easy design of the residual pile supporting unit 24 and therefore of the sheet feeder 10.

After the residual pile bars 38 are retracted, steps S1 to S5 (FIG. 6) can be repeated, preferably without interruption for continuous operation of the sheet feeder 10.

The invention claimed is:

1. A method for changing a sheet pile in a sheet feeder for a sheet treating machine, the method comprising:

detecting a limit height of a sheet pile processed in the sheet feeder, wherein the sheet pile is supported on a pallet being arranged on a main pile supporting unit, supporting the sheet pile by a residual pile supporting unit in that a plurality of residual pile bars are pushed into respective slots of the pallet, withdrawing the pallet being arranged on the main pile supporting unit from the sheet pile and placing a replacement pallet carrying a replacement sheet pile on the main pile supporting unit, bringing an upper end of the replacement sheet pile in contact with the residual pile bars such that the residual pile bars are engaged between a lower end of the sheet pile and an upper end of the replacement sheet pile, and retracting the residual pile bars from a sheet pile region such that the sheet pile is supported on the replacement sheet pile, wherein the residual pile bars oscillate along a direction of extension of the residual pile bars while being retracted.

2. The method according to claim 1, wherein all residual pile bars are retracted at the same time, with the same speed, and/or with the same oscillations.

* * * * *